US011057699B2

(12) United States Patent
Sakaguchi et al.

(10) Patent No.: US 11,057,699 B2
(45) Date of Patent: Jul. 6, 2021

(54) SPEAKER DEVICE AND AREA REPRODUCTION APPARATUS

(71) Applicant: PANASONIC INTELLECTUAL PROPERTY CORPORATION OF AMERICA, Torrance, CA (US)

(72) Inventors: Atsushi Sakaguchi, Kyoto (JP); Toshiyuki Matsumura, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/780,279

(22) Filed: Feb. 3, 2020

(65) Prior Publication Data

US 2020/0260178 A1 Aug. 13, 2020

(30) Foreign Application Priority Data

Feb. 13, 2019 (JP) ..... JP2019-023515

(51) Int. Cl.
*H04R 1/30* (2006.01)
*H04R 3/12* (2006.01)
*H04R 1/40* (2006.01)

(52) U.S. Cl.
CPC ..... *H04R 1/30* (2013.01); *H04R 1/403* (2013.01); *H04R 3/12* (2013.01)

(58) Field of Classification Search
CPC ..... H04R 1/30; H04R 1/2861; H04R 1/2865
USPC ..... 381/340–342
See application file for complete search history.

(56) References Cited

U.S. PATENT DOCUMENTS 1,855,836 A * 4/1932 King ..... H04R 1/2865 381/340
2,746,558 A * 5/1956 Levy ..... G10K 11/025 381/340
7,177,437 B1 * 2/2007 Adams ..... H04R 1/30 381/337
7,178,629 B2 * 2/2007 Vincenot ..... H04R 1/30 381/340
7,631,724 B2 * 12/2009 Onishi ..... H04R 1/323 381/340

FOREIGN PATENT DOCUMENTS

JP 2015-231087 12/2015

* cited by examiner

*Primary Examiner* — Suhan Ni
(74) *Attorney, Agent, or Firm* — Greenblum & Bernstein, P.L.C.

(57) ABSTRACT

A speaker device includes a speaker that outputs sound, a horn that emits sound output from the speaker, and a slit opening that is formed on a front surface of the horn, a vertical side of the slit opening being longer than a horizontal side of the slit opening. It is possible to prevent reflection of unnecessary sound in a vertical direction and enhance sound reproduction performance in a horizontal direction.

9 Claims, 18 Drawing Sheets

SPEAKER DEVICE AND AREA REPRODUCTION APPARATUS

FIELD OF THE INVENTION

The present disclosure relates to a speaker device that outputs sound and an area reproduction apparatus that outputs sound from a speaker array in which a plurality of the speaker devices are arranged in a predetermined area.

BACKGROUND ART

Conventionally, there has been known an area reproduction technique that uses a plurality of speakers to present sound only at a specific position or presents different sound at different positions in the same space without any mutual interference. By using this area reproduction technique, it is possible to present the reproduced sound of different contents or different volumes to different users. For example, Japanese Unexamined Patent Application Publication No. 2015-231087 discloses an area reproduction technique based on spatial filtering.

However, the conventional technique described above cannot prevent reflection of unnecessary sound in a vertical direction and cannot achieve sufficient reproduction performance in a horizontal direction. Consequently, further improvement is required.

SUMMARY OF THE INVENTION

The present disclosure has been achieved in order to solve the problems described above, and an object of the present disclosure is to provide a speaker device and an area reproduction apparatus that can prevent reflection of unnecessary sound in a vertical direction and can enhance sound reproduction performance in a horizontal direction.

A speaker device according to the present disclosure includes a speaker that outputs sound, a horn that emits the sound output from the speaker, and a slit opening that is formed on a front surface of the horn, a vertical side of the slit opening being longer than a horizontal side of the slit opening.

Figure 1:
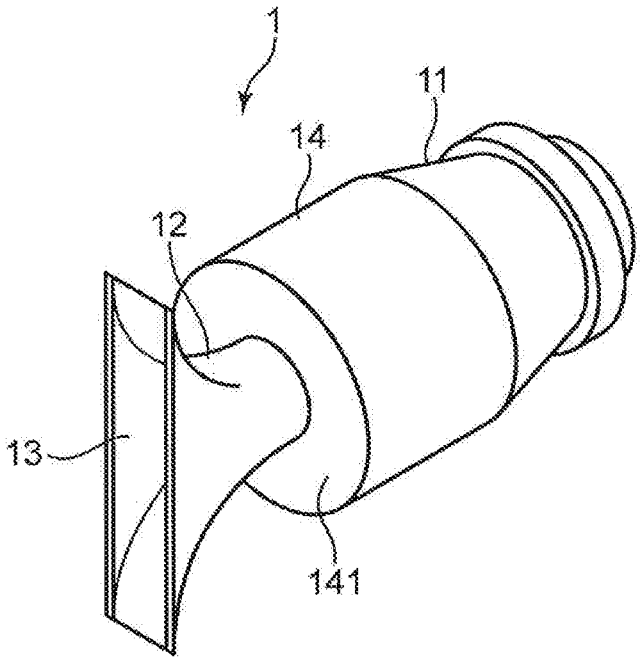
FIG. 1 is a perspective view of an appearance of a speaker device according to a first embodiment of the present disclosure.

DESCRIPTION OF EMBODIMENTS (Knowledge on which the Present Disclosure Relies)

In a conventional area reproduction technique based on spatial filtering, as a reproduction condition, an arbitrary control line parallel to a speaker array is set first, and then a reproduction line in which reproduced sound is intensified and a non-reproduction line in which reproduced sound is weakened are set on the control line. Next, a control filter for achieving area reproduction under the set reproduction condition is derived. Area reproduction is finally achieved under the set reproduction condition by causing each speaker to output a signal obtained by convolving a signal of the reproduced sound with the derived control filter. The control filter and the reproduction condition are related to each other by a spatial Fourier transform.

In the conventional area reproduction technique, the control filter is derived assuming that a speaker is a point sound source. In actuality, however, the speaker is not the point sound source. In particular, as a conventional speaker has forward directivity in an intermediate-to-high-frequency band, reproduction performance in a lateral direction (horizontal direction) may be degraded.

In addition, a conventional control method controls sound in the horizontal direction (direction in which speaker array is arranged), but not sound in the vertical direction. For this reason, sound output from the speaker array is reflected on a ceiling and a floor of a space, and the reproduction performance may be degraded by the reflected sound.

In order to solve the above problems, a speaker device according to an aspect of the present disclosure includes a speaker that outputs sound, a horn that emits the sound output from the speaker, and a slit opening that is formed on a front surface of the horn, a vertical side of the slit opening being longer than a horizontal side of the slit opening.

According to this configuration, the slit opening whose vertical side is longer than a horizontal side is formed on the front surface of the horn that emits the sound output from the speaker. With a horn effect of the horn, it is possible to prevent sound emitted from the slit opening from spreading in the vertical direction, and thus to prevent unnecessary sound from being reflected in the vertical direction. With a diffraction effect of the slit opening, horizontal directivity of the sound emitted from the slit opening can be made close to a point sound source, and sound reproduction performance in the horizontal direction can be enhanced.

In the speaker device described above, the speaker device may be used for a speaker array that reproduces the sound in a predetermined area, and a plurality of speaker devices may be arranged in the speaker array.

According to this configuration, the speaker device is used for the speaker array that reproduces the sound in a predetermined area and the speaker devices are arranged in the speaker array. Consequently, it is possible to prevent the sound reproduced in the predetermined area from being unnecessarily reflected in the vertical direction and to enhance the sound reproduction performance in the horizontal direction.

In the speaker device described above, the slit opening may be formed inside of an outer edge of the front surface of the horn.

According to tins configuration, sound can be emitted from the slit opening that is formed inside of the outer edge of the front surface of the horn.

In the speaker device described above, an outer edge of the slit opening may match an outer edge of the front surface of the horn.

According to this configuration, sound can be emitted from the slit opening that has the outer edge matching the outer edge of the front surface of the horn.

The speaker device described above may further include a connecting part that connects the speaker and the horn and has a space inside. The connecting part may remove sound in a predetermined frequency band from the sound output from the speaker.

According to this configuration, the connecting part that connects the speaker and the horn and has a space inside can remove the sound in a predetermined frequency band from the sound output from the speaker.

In the speaker device described above, the connecting part may include a front panel provided in a direction of outputting the sound and a sound conduit that penetrates the front panel and is connected to a rear end part of the horn, and a gap may be formed between a rear end part of the sound conduit and a front surface of the speaker.

According to this configuration, the sound output from the speaker can be transmitted through the sound conduit that penetrates the front panel and is connected to the rear end part of the horn to the horn.

In the speaker device described above, the connecting part may connect the speaker and the horn with a center of the speaker matching a center of the horn.

According to this configuration, the speaker is connected via the connecting part to the horn with the center of the speaker matching the center of the horn, and thus the sound output from the speaker can be directly transmitted to the horn.

In the speaker device described above, the connecting part may connect the speaker and the horn with a center of the speaker shifting from a center of the horn.

According to this configuration, the speaker is connected via the connecting part to the horn with the center of the speaker shifting from the center of the horn. Consequently, when a plurality of the speaker devices are arranged, the interval between adjacent speaker devices can be determined depending not on the horizontal length of the speaker but on the horizontal length of the horn. As a result, the horizontal length of the horn is shorter than the horizontal length of the speaker and thus it is possible to downsize the speaker array constituted by the speaker devices and to further widen a controllable frequency band.

Further, in the speaker device described above, the horn may include a folding part that reflects the sound in a direction opposite to a direction of outputting the sound and a reflecting part that reflects the sound reflected by the folding part again in the direction of outputting the sound.

According to this configuration, the folding part reflects the sound in the direction opposite to the direction of outputting the sound and the reflecting part reflects the sound reflected by the folding part again in the direction of outputting the sound. Consequently, the length of the horn in the direction of outputting the sound can be further reduced and the speaker device can be downsized accordingly.

An area reproduction apparatus according to another aspect of the present disclosure includes a speaker array in which a plurality of speaker devices are arranged and an output controller that adjusts a sound pressure of sound to be output from each of the plurality of speaker devices and reproduces the sound in a predetermined area, based on a control line including a reproduction line in which sound waves emitted from the speaker array are intensified and a non-reproduction line in which the sound waves are weakened. Each of the plurality of speaker devices is any of the speaker devices described above.

According to this configuration, each of the speaker devices includes a slit opening whose vertical side is longer than a horizontal side, the slit opening being formed on a front surface of a horn that emits sound output from the speaker. With the horn effect of the horn, it is possible to prevent sound emitted from the slit opening from spreading in the vertical direction, and thus to prevent unnecessary sound from being reflected in the vertical direction. In addition, with the diffraction effect of the slit opening, horizontal directivity of the sound emitted from the slit opening can be made close to a point sound source, and sound reproduction performance in the horizontal direction can be enhanced.

Hereinafter, embodiments of the present disclosure will be described with reference to the accompanying drawings. Note that the following embodiments are merely embodied examples of the present disclosure, and are not intended to limit the technical scope of the present disclosure.

First Embodiment

Figure 2:
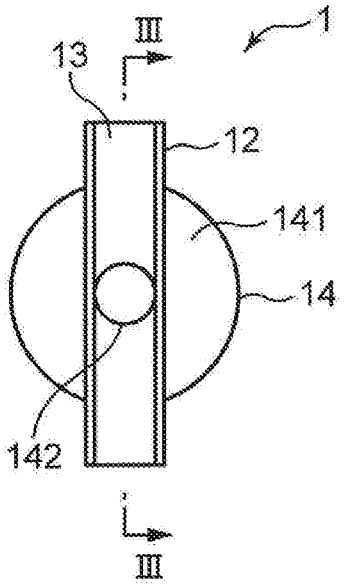
FIG. 2 is a front view of the speaker device illustrated in FIG. 1.
Figure 3:
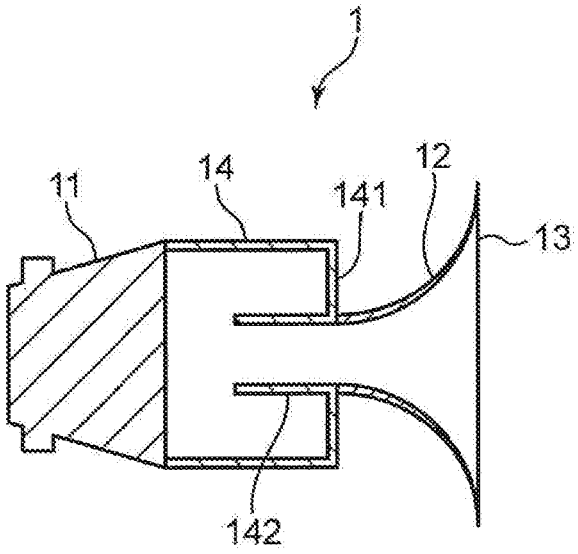
FIG. 3 is a cross-sectional view of the speaker device illustrated in FIG. 2, taken along a line III-III.

FIG. 1 is a perspective view of an appearance of a speaker device according to a first embodiment of the present disclosure. FIG. 2 is a front view of the speaker device illustrated in FIG. 1. FIG. 3 is a cross-sectional view of the speaker device illustrated in FIG. 2, taken along a line III-III.

A speaker device 1 illustrated in FIGS. 1, 2, and 3 includes a speaker 11, a horn 12, a slit opening 13, and a connecting part 14.

The speaker 11 outputs sound. The horn 12 emits sound output from the speaker 11. The slit opening 13 is formed on a front surface of the horn 12. The slit opening 13 has a rectangular shape whose vertical side is longer than a horizontal side. An outer edge of the slit opening 13 matches an outer edge of the front surface of the horn 12.

The connecting part 14 connects the speaker 11 and the horn 12, and has a space inside. The connecting part 14 removes sound in a predetermined frequency band from the sound output from the speaker 11. The connecting part 14 includes a front panel 141 and a sound conduit 142. The front, panel 141 is provided in a sound output direction. The sound conduit 142 penetrates the front panel 141 and is connected to a rear end part of the horn 12. A gap is formed between a rear end part of the sound conduit 142 and a front surface of the speaker 11. The connecting part 14 has a cylindrical shape. A rear end of a side surface of the connecting part 14 is connecting to an outer edge of the circular front surface of the speaker 11. The connecting part 14 connects the speaker 11 and the horn 12 with a center of the speaker 11 matching a center of the horn 12.

While the connecting part 14 of the first embodiment has a cylindrical shape, the present disclosure is not particularly limited thereto. The connecting part 14 may have a prismatic shape having a polygon such as a quadrangle as a bottom surface.

Sound output from the speaker 11 travels through the internal space in the connecting part 14, passes through the sound conduit 142, and enters the horn 12. The sound having entered the horn 12 is emitted from the slit opening 13 formed on the front surface of the horn 12.

The rear end part of the horn 12 has a circular shape and is connected to the sound conduit 142 having a cylindrical shape. A diameter of the rear end part of the horn 12 is equal to a diameter of the sound conduit 142. An upper part and a lower part of the horn 12 are exponentially curved from the rear end part connected to the sound conduit 142 toward a front end part. The front end part of the horn 12 has a rectangular shape whose horizontal length is shorter than a vertical length. The horn 12 and the sound conduit 142 may be integrally formed, or may be formed as separate members.

A side of the slit opening 13 in the vertical direction is longer than a diameter of the front surface of the speaker 11, and a side of the slit opening 13 in the horizontal direction is shorter than the diameter of the front surface of the speaker 11. The side of the slit opening 13 in the horizontal direction is substantially equal to the diameter of the sound conduit 142. It is only required that the side of the slit opening 13 in the horizontal direction has a length that achieves a diffraction effect as a point sound source.

Figure 4:
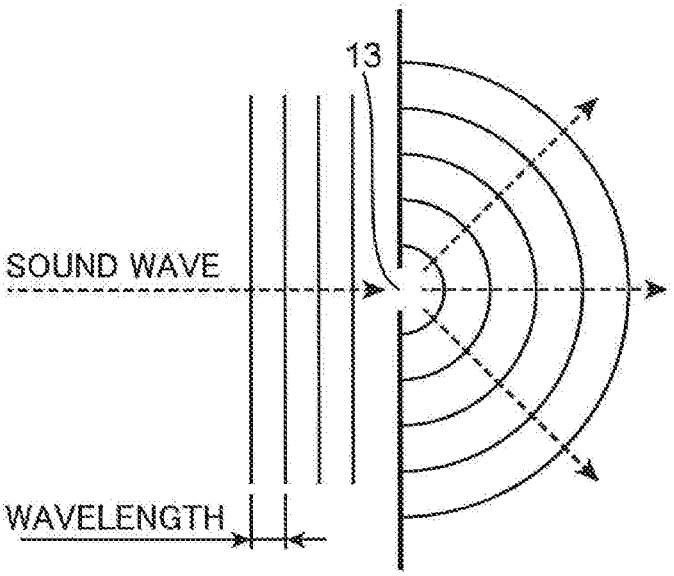
FIG. 4 is a view for describing sound in a horizontal direction, the sound being emitted from a slit opening in the first embodiment.

FIG. 4 is a view for describing sound in the horizontal direction, the sound being emitted from the slit opening in the first embodiment. FIG. 4 illustrates the slit opening 13 as viewed from above.

As illustrated in FIG. 4, a sound wave having entered the slit opening 13 is diffracted by the slit opening 13. With a diffraction effect of the slit opening 13, horizontal directivity of the sound emitted from the slit opening 13 can be made close to a point sound source, and sound reproduction performance in the horizontal direction can be enhanced.

Figure 5:
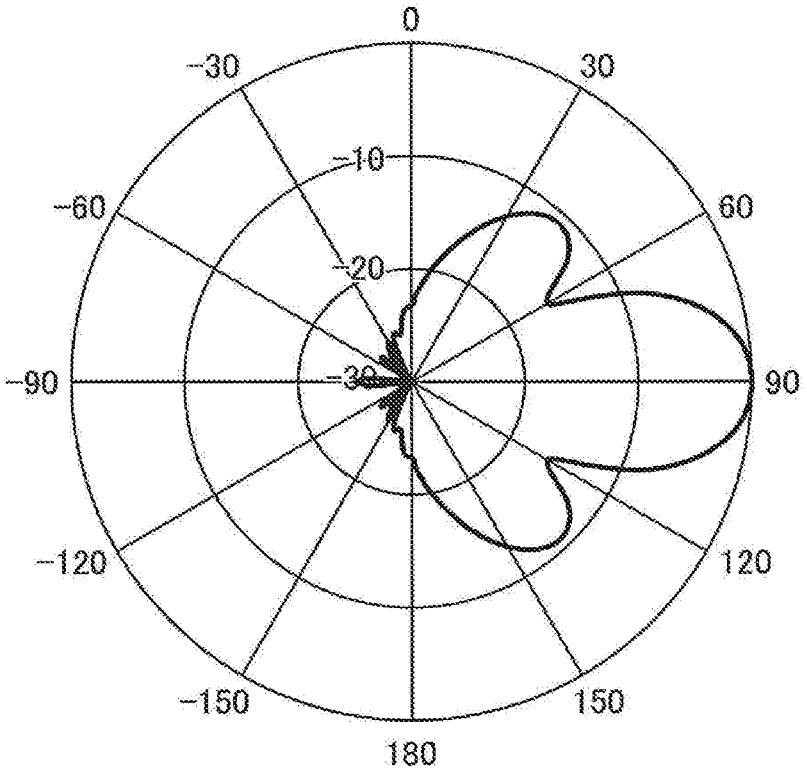
FIG. 5 is a view for describing sound in a vertical direction, the sound being emitted from the slit opening in the first embodiment.

FIG. 5 is a view for describing sound in the vertical direction, the sound being emitted from the slit opening in the first embodiment. FIG. 5 illustrates directivity of the sound in the vertical direction emitted from the slit opening 13, and the sound is emitted from a center of FIG. 5 toward the right.

As illustrated in FIG. 5, as the horn 12 is extended in the vertical direction, the directivity, in the vertical direction, of the sound emitted from the slit opening 13 is narrowed.

Figure 6:
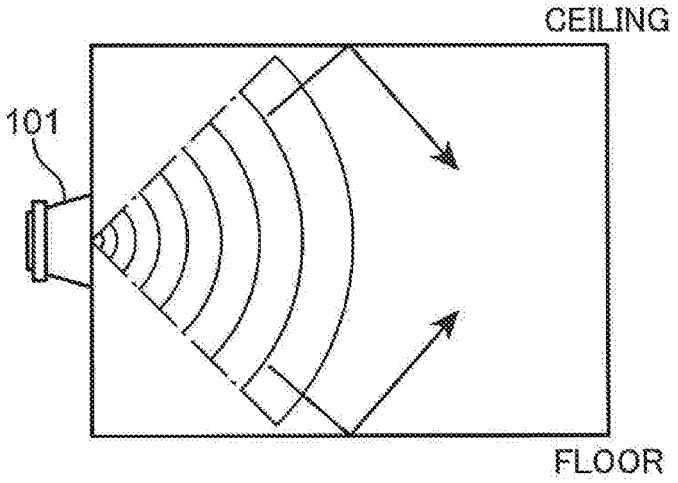
FIG. 6 is a view illustrating spread of sound in the vertical direction in a conventional speaker.
Figure 7:
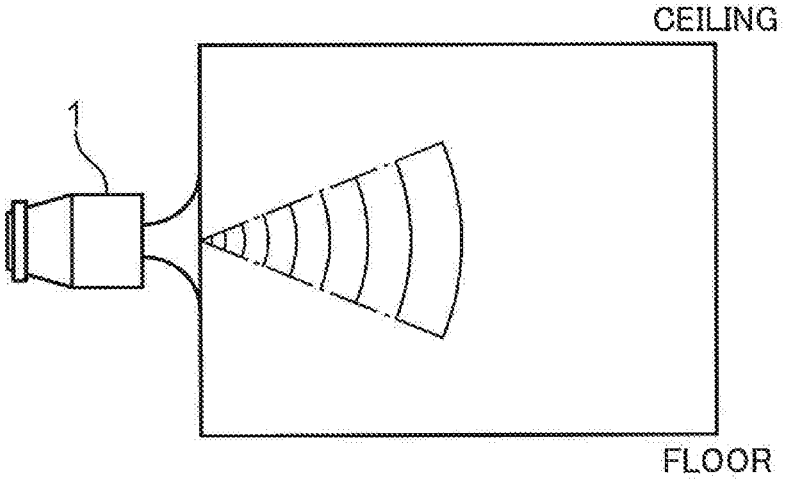
FIG. 7 is a view illustrating the spread of sound in the vertical direction in the speaker device according to the first embodiment.

FIG. 6 is a view illustrating spread of sound in the vertical direction in a conventional speaker. FIG. 7 is a view illustrating the spread of sound in the vertical direction in the speaker device according to the first embodiment. FIGS. 6 and 7 respectively illustrate a conventional speaker 101 and the speaker device 1 according to the first embodiment, as viewed from the horizontal direction.

As illustrated in FIG. 6, sound output from the conventional speaker 101 diffuses in the vertical direction and reflected on a ceiling and a floor. The sound reflected from the ceiling and floor may make it difficult to hear the original sound.

On the other hand, as illustrated in FIG. 7, the speaker device 1 according to the first embodiment has forward directivity, and thus the sound output from the speaker device 1 is prevented from diffusing in the vertical direction. With a horn effect of the horn 12, it is possible to prevent the sound emitted from the slit opening 13 from spreading in the vertical direction, and thus to prevent unnecessary sound from being reflected in the vertical direction.

A configuration of the connecting part 14 is represented by an acoustic circuit. The acoustic circuit is capable of representing a behavior of a sound wave propagating in the connecting part 14 with an electric circuit.

Figure 8:
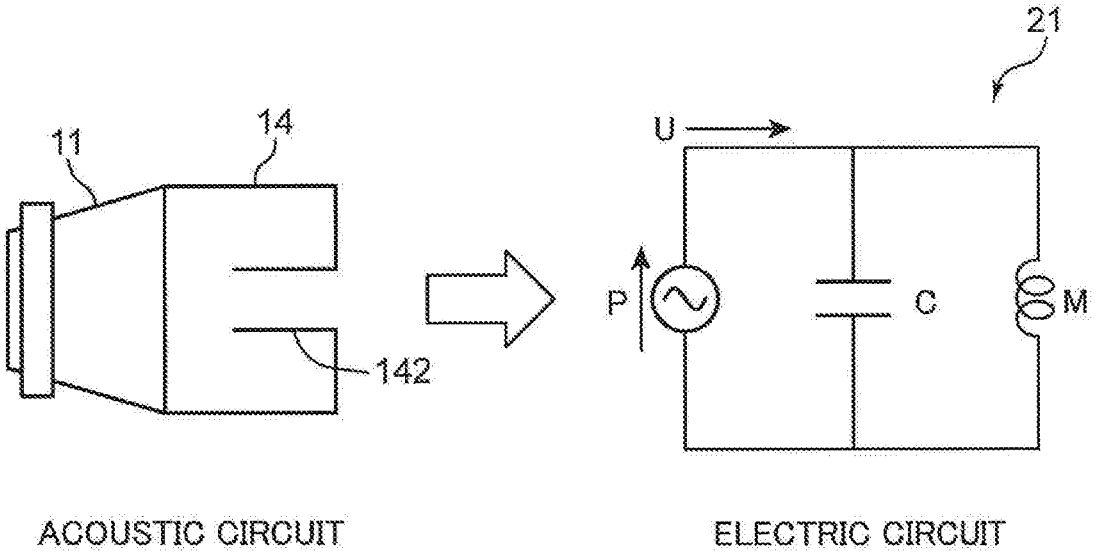
FIG. 8 is a diagram of an electric circuit corresponding to an acoustic circuit of a connecting part in the first embodiment.

FIG. 8 is a diagram of an electric circuit corresponding to an acoustic circuit of the connecting part in the first embodiment.

A current in an electric circuit 21 is represented by a volume velocity U, and a voltage in the electric circuit 21 is represented by a sound pressure P. The connecting part 14 functions as a high cut filter in the electric circuit 21. Hereinafter, a cutoff frequency of the connecting part 14 will be described.

First, a volume of a cavity in the connecting part 14 can be replaced with a capacity of the electric circuit 21. Consequently, a capacity C is expressed by the following equation (1) using a volume V of the connecting part 14, an air density ρ, and a sound velocity c.

$$C=V/\rho c^2 \tag{1}$$

An inertance of the sound conduit 142 of the connecting part 14 can be replaced with an inductor in the electric circuit 21. Consequently, an inductance M is expressed by the following equation (2) using the air density ρ, a length l of the sound conduit 142, and a cross-sectional area S of the sound conduit 142.

$$M=\rho l/S \tag{2}$$

A cutoff frequency F of the connecting part 14 is expressed by the following equation (3) using the capacity C and the inductance M.

$$F=1/(2\pi\mathrm{sqrt}(MC)) \tag{3}$$

As described above, by adjusting the volume of the connecting part 14 and the length and cross-sectional area of the sound conduit 142, a desired cutoff frequency can be obtained, and sound in an unnecessary frequency band can be removed by the connecting part 14.

Next, an area reproduction apparatus using the speaker device 1 according to the first embodiment will be described.

Figure 9:
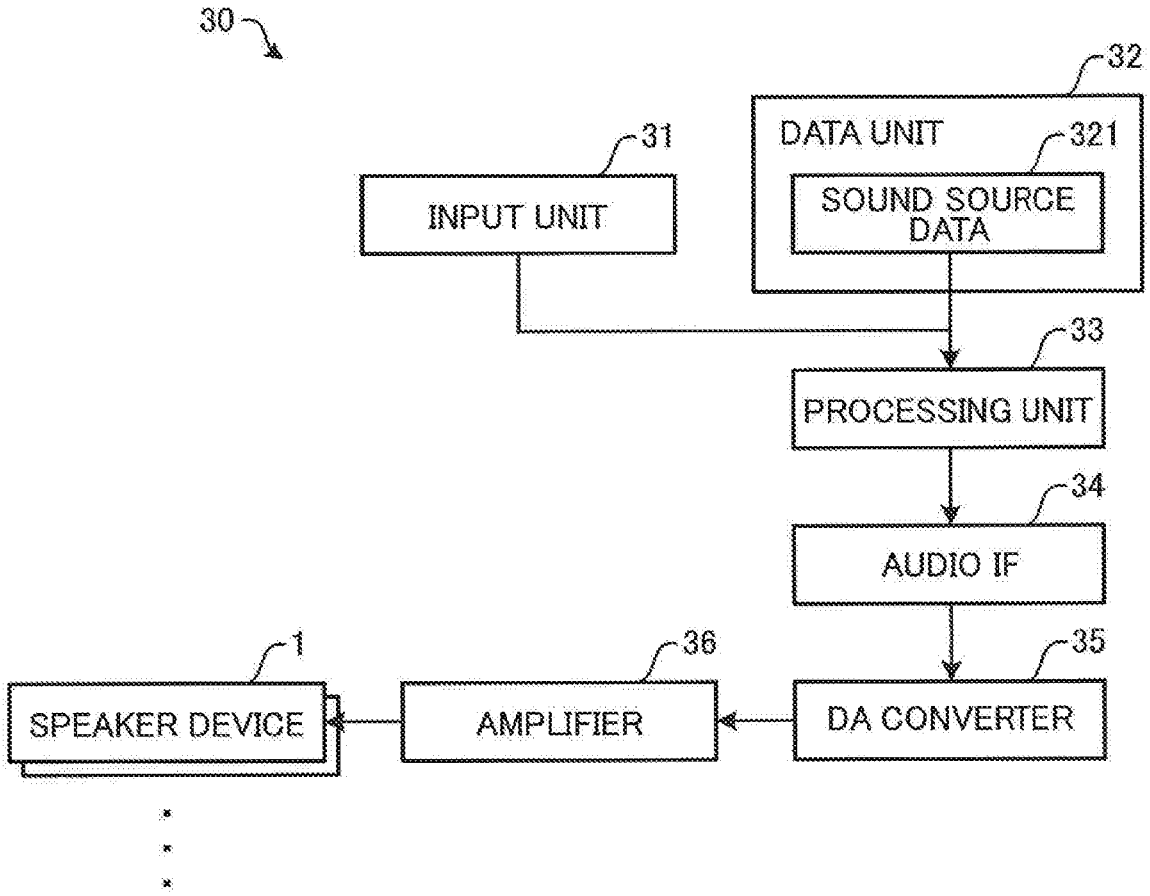
FIG. 9 is a diagram illustrating a configuration of an area reproduction apparatus according to the first embodiment of the present disclosure.

FIG. 9 is a block diagram illustrating a configuration of an area reproduction apparatus according to the first embodiment of the present disclosure. An area reproduction apparatus 30 includes an input unit 31, a data unit 32, a processing unit 33, an audio interface (IF) 34, a DA converter 35, an amplifier 36, and a plurality of the speaker devices 1.

The input unit 31 is, for example, a touch panel, and accepts various operations of specifying, for example, sound source data 321 of sound to be reproduced by the speaker device 1, reproduction conditions to be described later, and a reproduction volume. The input unit 31 is not limited to a touch panel, and may be a physical switch, a keyboard, a mouse, and a display device.

The input unit 31 may be a terminal device such as a smartphone, a tablet computer, or a personal computer used by a user of the area reproduction apparatus 30, or may be a terminal device such as a personal computer that is provided in a room that is an area reproduction target for the area reproduction apparatus 30 and is shared by a plurality of users.

The data unit 32 is a storage device such as a semiconductor memory or a hard disk drive (HDD). The data unit 32 stores the sound source data 321. The sound source data 321 is stored in the data unit 32 via a network such as the Internet. The data unit 32 may be provided in the same device as the processing unit 33 to be described later, or may be provided in a device different from the processing unit 33.

The processing unit 33 is an information processing apparatus including a microprocessor, a digital signal processor (DSP), a read only memory (ROM), a random access memory (RAM), an HDD, and the like.

The processing unit 33 generates a control filter for achieving area reproduction under a reproduction condition specified by a user using the input unit 31. The processing unit 33 generates a drive signal, where a reproduced sound signal (hereinafter, "reproduced sound signal corresponding to sound source data 321") obtained by converting the sound source data 321 specified by the user using the input unit 31 into an analog signal is convolved with the control filter generated.

The audio IF 34 outputs the drive signal generated by the processing unit 33 to the DA converter 35.

The DA converter 35 converts the drive signal input from the audio IF 34 into an analog signal.

The amplifier 36 amplifies the analog signal (hereinafter, "reproduced sound signal") converted by the DA converter 35.

The speaker device 1 outputs reproduced sound indicated by the reproduced sound signal amplified by the amplifier 36. The speaker device 1 is used for a speaker array that reproduces sound in a predetermined area. In the speaker array, a plurality of the speaker devices 1 are arranged.

The area reproduction apparatus 30 includes the speaker devices 1. The speaker array is constituted by the speaker devices 1 arranged in a straight line at predetermined intervals. As will be described later, area reproduction performance varies depending on the interval between the speaker devices 1 arranged, the total length of the speaker array, and the like. While the speaker devices 1 are arranged in a straight line in the first embodiment, the present disclosure is not particularly limited thereto, and the speaker devices 1 may be arranged in an are shape.

Figure 10:
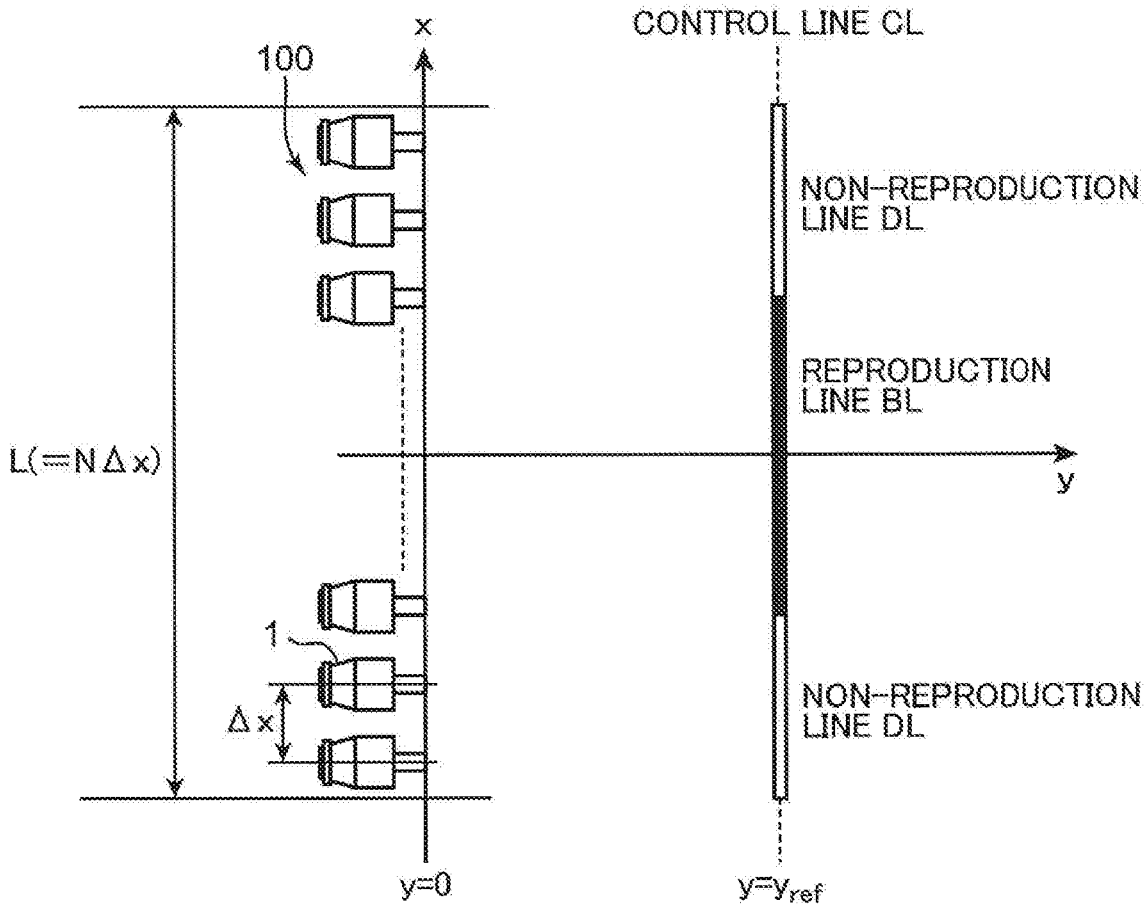
FIG. 10 illustrates an example of a reproduction line and a non-reproduction line in the first embodiment.

FIG. 10 illustrates an example of a reproduction line and a non-reproduction line in the first embodiment. In order to achieve area reproduction, as illustrated in FIG. 10, it is only required that a reproduction line BL in which sound waves emitted from the speaker array 100 are intensified and a non-reproduction line DL in which the sound waves are weakened are set on a control line CL that is substantially parallel to the speaker array 100 and set at a position separated from the speaker array 100 by a distance $y_{ref}$. While the control line CL is linear in the first embodiment, the present disclosure is not particularly limited thereto, and the control line CL may be arcuate.

The processing unit 33 adjusts the sound pressure of sound to be output from each of the speaker devices 1 and reproduces the sound in a predetermined area, based on the control line CL including the reproduction line BL in which sound waves emitted from the speaker array 100 are intensified and the non-reproduction line DL in which the sound waves are weakened. An area reproduction method of the first embodiment is a well-known technique, and thus a detailed description thereof is omitted.

A frequency band that can be controlled by the speaker array 100 is determined by an interval Δx between the speaker devices 1. The interval Δx is a distance between centers of adjacent speaker devices 1. When the interval Δx is reduced, the frequency band that can be controlled by the speaker array 100 can be widened. If the speaker array 100 can control sound up to, for example, 8 kHz, the connecting part 14 is designed so as to achieve a cutoff frequency F of 8 kHz.

Figure 11:
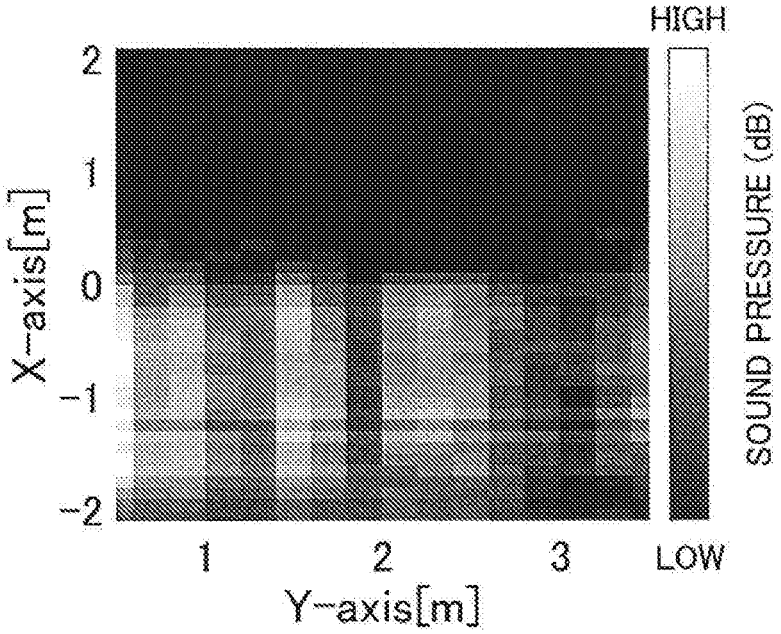
FIG. 11 shows an actual measurement result of a sound pressure distribution on an x-y axis plane, reproduced by an area reproduction apparatus using the conventional speaker for a speaker array.
Figure 12:
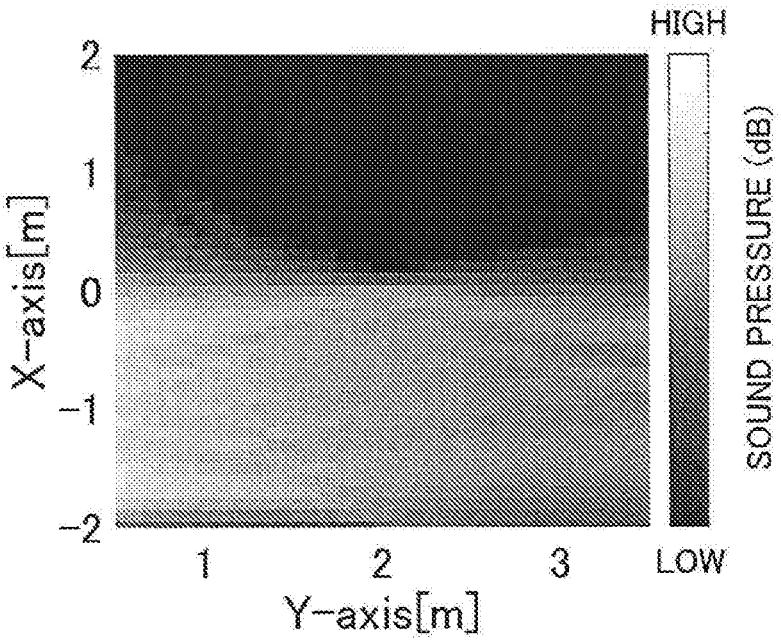
FIG. 12 shows a simulation result of the sound pressure distribution on the x-y axis plane, reproduced by an area reproduction apparatus using the speaker device of the first embodiment for a speaker array.

FIG. 11 shows an actual measurement result of a sound pressure distribution on an x-y axis plane, reproduced by an area reproduction apparatus using a conventional speaker for a speaker array. FIG. 12 shows a simulation result of the sound pressure distribution on the x-y axis plane, reproduced by an area reproduction apparatus using the speaker device of the first embodiment for a speaker array.

It is assumed in FIG. 11 that the speaker array 100 is constituted by 64 (N=64) speakers 101 arranged on an x-axis. Further, it is assumed that tire interval Δx between the speakers 101 arranged is, for example, 35 mm. Moreover, it is assumed that a line orthogonal to an x-axis direction center of an array line along the speaker array 100 is a y-axis, and the distance $y_{ref}$ between the speaker array 100 and the control line CL is 2 m. A width of the reproduction line BL on the control line CL is 1 m, and the x-axis direction center of the reproduction line BL is at a position of −1 m. That is, the area reproduction apparatus reproduces sound only in an area on the right side from the center of the speaker array 100. FIGS. 11 and 12 illustrate a sound pressure distribution of 2000 Hz sound. FIG. 12 shows a simulation result when area reproduction is performed assuming that the speaker is a point sound source under the same condition as the condition under which area reproduction is performed using the conventional speaker illustrated in FIG. 11 for the speaker array.

In the conventional speaker of FIG. 11, the area reproduction is appropriately performed on reproduced sound emitted from the speaker array in the reproduction line BL on the control line CL. However, as it moves backward away from the control line CL, the sound pressure decreases and area reproduction performance is degraded. On the other hand, in the speaker device 1 of the first embodiment illustrated in FIG. 12, the reproduced sound emitted from the speaker array 100 has a constant sound pressure not only on the control line CL but also behind the control line CL. Degraded area reproduction performance behind the control line CL can thus be improved.

Second Embodiment

Figure 13:
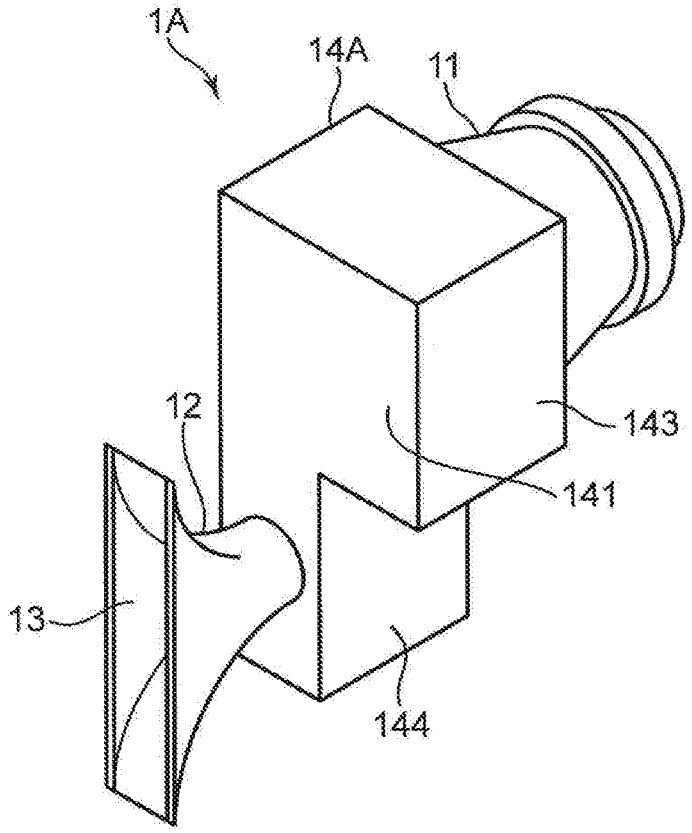
FIG. 13 is a perspective view of an appearance of a speaker device according to a second embodiment of the present disclosure.
Figure 14:
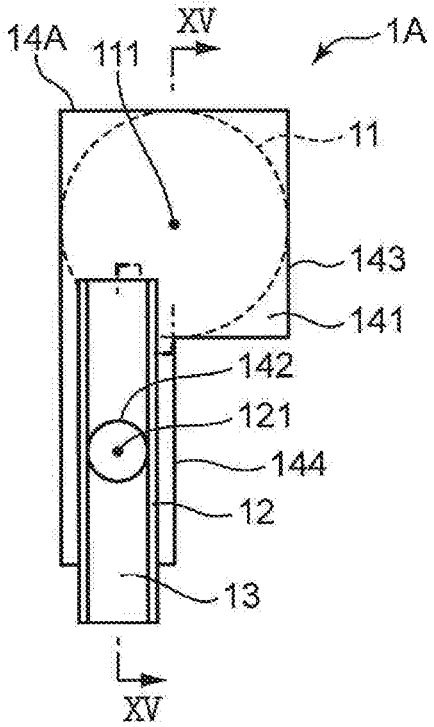
FIG. 14 is a front view of the speaker device illustrated in FIG. 13.
Figure 15:
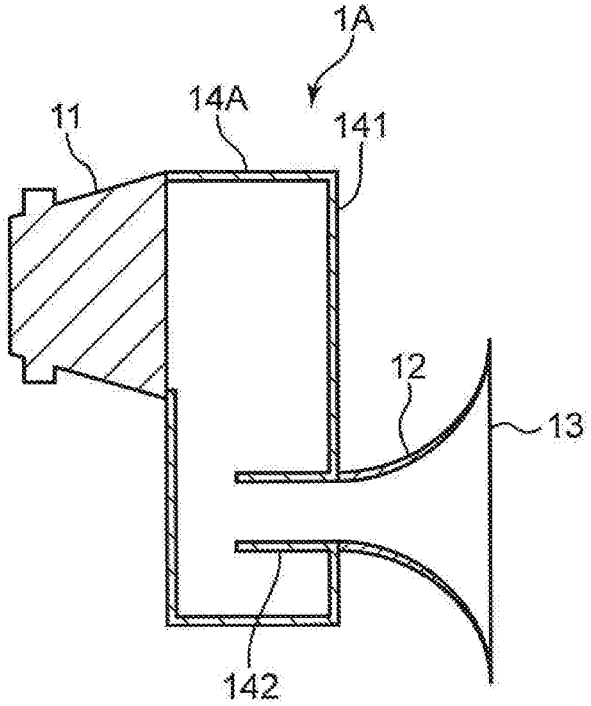
FIG. 15 is a cross-sectional view of the speaker device illustrated in FIG. 14, taken along a line XV-XV.

FIG. 13 is a perspective view of an appearance of a speaker device according to a second embodiment of the present disclosure. FIG. 14 is a front view of the speaker device illustrated in FIG. 13. FIG. 15 is a cross-sectional view of the speaker device illustrated in FIG. 14, taken along a line XV-XV.

A speaker device 1A illustrated in FIGS. 13,14, and 15 includes a speaker 11, a horn 12, a slit opening 13, and a connecting part 14A. Note that in the second embodiment, the same components as those of the speaker device 1 according to the first embodiment are denoted by the same reference numerals, and a description thereof will be omitted.

The connecting part 14A connects the speaker 11 and the horn 12, and has a space inside. The connecting part 14A removes sound in a predetermined frequency band from sound output from the speaker 11. The connecting part 14A includes a front panel 141 and a sound conduit 142. The front panel 141 is provided in a sound output direction. The sound conduit 142 penetrates the front panel 141 and is connected to a rear end part of the horn 12. A gap is formed between a rear end part of the sound conduit 142 and a back surface of the connecting part 14A including a front surface of the speaker 11.

Connecting part 14A of the second embodiment connects the speaker 11 and the horn 12 with a center 111 of the speaker 11 shifting from a center 121 of the horn 12. The connecting part 14A has a shape in which a part of a rectangular parallelepiped is cut away. A front surface of the connecting part 14A has an L-shape in which a square is combined with a rectangle having a side obtained by extending one side of the square in tire vertical direction.

The connecting part 14A includes a first connecting part 143 having an opening formed according to the shape of the front surface of the speaker 11 and a second connecting part 144 that is connected to a space in the first connecting part 143 and has an opening formed according to a cross-sectional shape of the sound conduit 142. The opening of the second connecting part 144 is formed on a surface facing the surface in which the opening of the first connecting part 143 is formed. The front surface of the speaker 11 is connected to the opening of the first connecting part 143. The sound conduit 142 and the horn 12 are connected to the opening of the second connecting part 144. A horizontal length of the second connecting part 144 is shorter than a horizontal length of the first connecting part 143, and is ½ of the horizontal length of the first connecting part 143.

Figure 16:
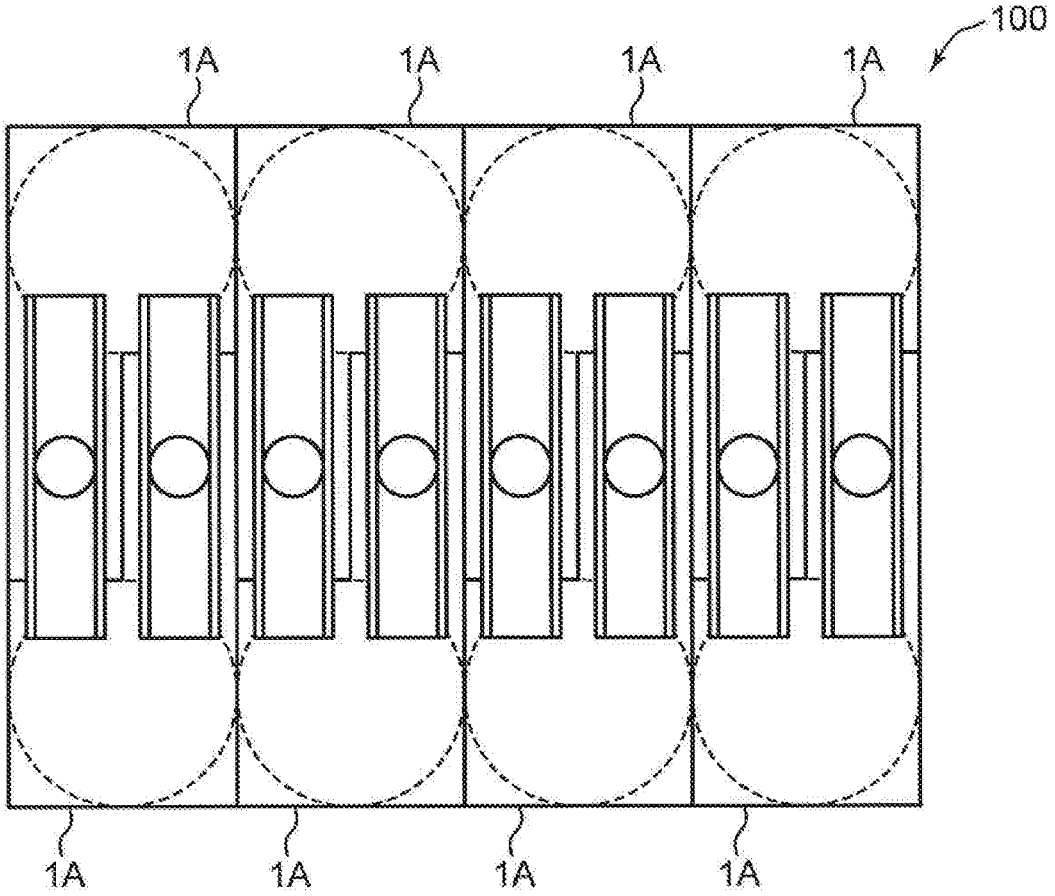
FIG. 16 is a view illustrating a configuration of a speaker array using the speaker device of the second embodiment.

FIG. 16 is a view illustrating a configuration of a speaker array using the speaker device of the second embodiment. FIG. 16 illustrates a speaker array 100 as viewed from the front.

As illustrated in FIG. 16, the speaker army 100 includes a plurality of the speaker devices 1A arranged with their vertical orientations alternately reversed. One speaker device 1A and the other speaker device 1A adjacent to the one speaker device 1A are arranged so that the second connecting parts 144 of these speaker devices 1A contact with each other and the centers of the horns 12 are aligned on a straight line. The other speaker device 1A is arranged with its vertical orientation reversed with respect to the one speaker device 1A.

The number of the speaker devices 1A constituting the speaker array 100 is not limited to the number illustrated in FIG. 16.

As described above, the speaker 11 is connected via the connecting part 14A to the horn 12 with the center of the speaker 11 shifting from the center of the horn 12. Consequently, when a plurality of the speaker devices 1A are arranged, the interval between adjacent speaker devices 1A can be determined depending not on the horizontal length of the speaker 11 but on the horizontal length of the horn 12.

In addition, the speaker devices 1A having an L-shape are arranged with their vertical orientations alternately reversed, and the horns 12 whose horizontal length is shorter than that of the speaker 11 are arranged adjacently. Consequently, the interval between the centers of the horns 12 of the speaker devices 1A adjacent to each other can be shorter than the interval between the centers of the speakers 11 of the speaker devices 1A adjacent to each other, and thus the speaker array can be downsized. Further, as the interval between the centers of the horns 12 of the speaker devices 1A adjacent to each other is shorter than the interval between the centers of the speakers 11 of the speaker devices 1A adjacent to each other, a controllable frequency band can be further widened.

Third Embodiment

Figure 17:
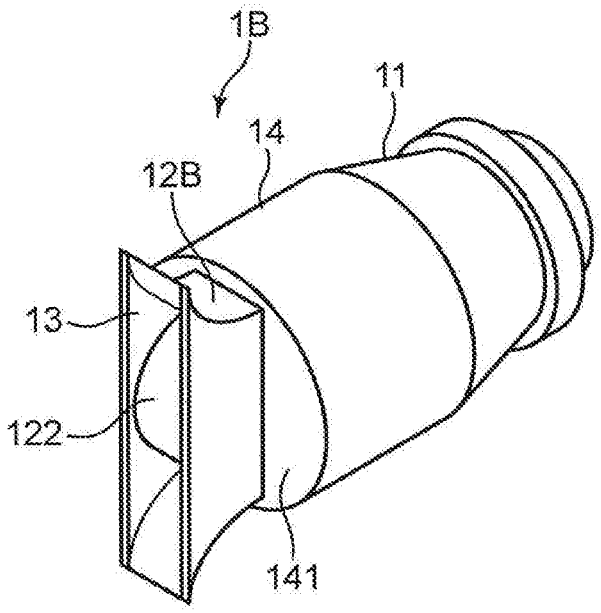
FIG. 17 is a perspective view of an appearance of a speaker device according to a third embodiment of the present disclosure.
Figure 18:
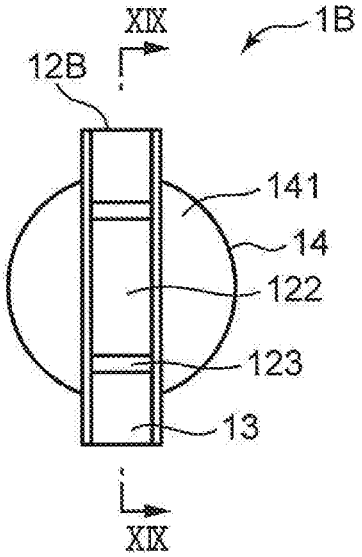
FIG. 18 is a front view of the speaker device illustrated in FIG. 17.
Figure 19:
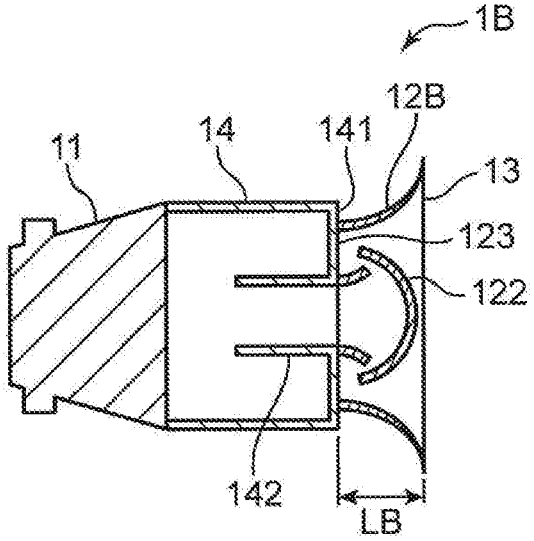
FIG. 19 is a cross-sectional view of the speaker device illustrated in FIG. 18, taken along line a XIX-XIX.

FIG. 17 is a perspective view of an appearance of a speaker device according to a third embodiment of the present disclosure. FIG. 18 is a front view of the speaker device illustrated in FIG. 17. FIG. 19 is a cross sectional view of the speaker device illustrated in FIG. 18, taken along a line XIX-XIX.

A speaker device 1B illustrated in FIGS. 17, 18 and 19 includes a speaker 11, a horn 12B, a slit opening 13, and a connecting part 14. Note that in the third embodiment, the same components as those of the speaker device 1 according to the first embodiment are denoted by the same reference numerals, and a description thereof will be omitted.

The horn 12B includes a folding part 122 that reflects sound in a direction opposite to a sound output direction and a reflecting part 123 that reflects sound reflected by the folding part 122 again in the output direction. The reflecting part 123 is a part of a front panel 141 of the connecting part 14, the part being covered with the horn 12B. A length LB of the horn 12B of the third embodiment in the sound output direction is shorter than the length of the horn 12 of the first embodiment in the sound output direction.

As illustrated in FIG. 19, sound that has passed through a sound conduit 142 is reflected by the folding part 122 in the direction opposite to the sound output direction. The sound reflected by the folding part 122 is reflected again by the reflecting part 123 in the sound output direction. The sound reflected by the reflecting part 123 passes through a gap between an upper end of the folding part 122 and an upper surface of the horn 12B and a gap between a lower end of the folding part 122 and a lower surface of the horn 12B, and is emitted from the slit opening 13.

As described above, the horn 12B includes the folding part 122 that reflects sound in the direction opposite to the sound output direction and the reflecting pail 123 that reflects the sound reflected by the folding part 122 again in the output direction. Consequently, the length LB of the horn 12B in the sound output direction can be further reduced and the speaker device 1B can be downsized.

Fourth Embodiment

Figure 20:
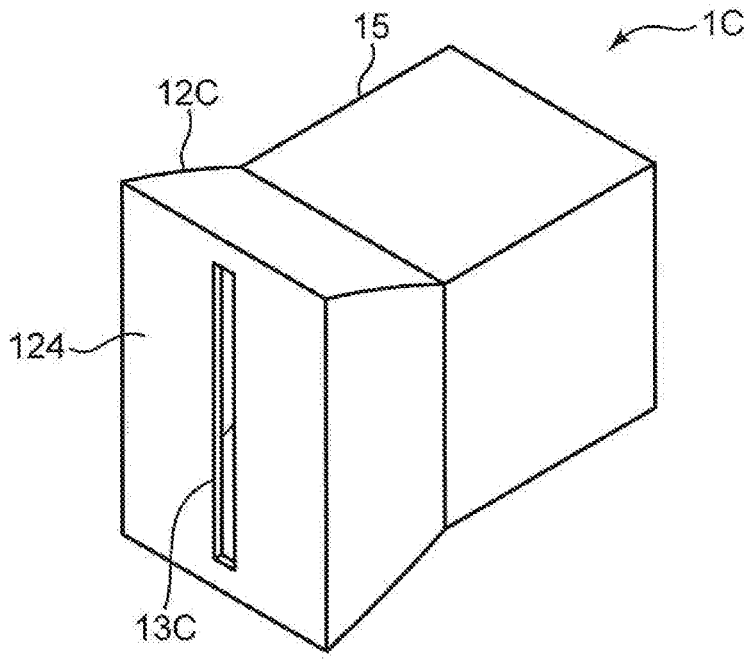
FIG. 20 is a perspective view of an appearance of a speaker device according to a fourth embodiment of the present disclosure.
Figure 21:
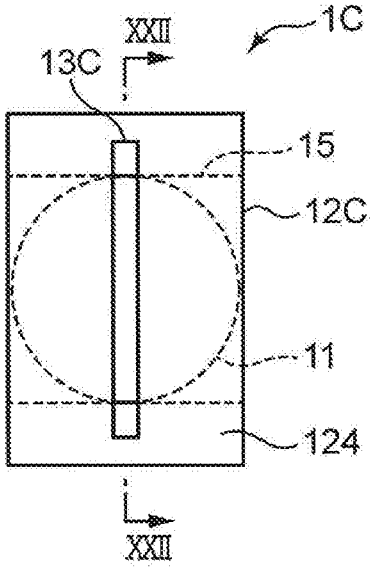
FIG. 21 is a front view of the speaker device illustrated in FIG. 20.
Figure 22:
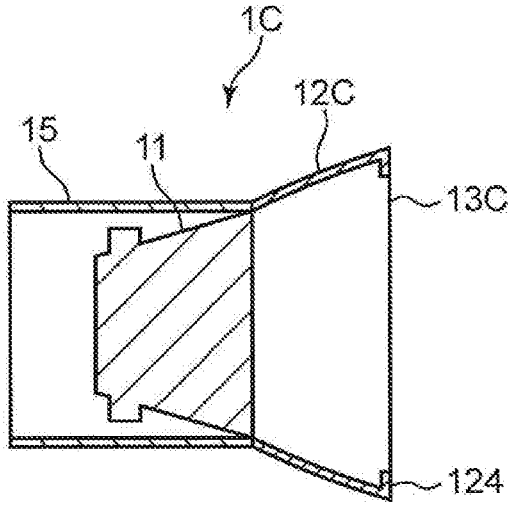
FIG. 22 is a cross-sectional view of the speaker device illustrated in FIG. 21, taken along a line XXII-XXII.

FIG. 20 is a perspective view of an appearance of a speaker device according to a fourth embodiment of the present disclosure. FIG. 21 is a front view of the speaker device illustrated in FIG. 20. FIG. 22 is a cross-sectional view of the speaker device illustrated in FIG. 21, taken along a line XXII-XXII.

A speaker device 1C illustrated in FIGS. 20, 21, and 22 includes a speaker 11, a horn 12C, a slit opening 13C, and a storage case 15. Note that in the fourth embodiment, the same components as those of the speaker device 1 of the first embodiment are denoted by the same reference numerals, and a description thereof will be omitted.

Unlike the speaker device 1 according to the first embodiment, the speaker device 1C according to the fourth embodiment does not include the connecting part 14.

The storage case 15 has a rectangular parallelepiped shape and stores the speaker 11 therein. A front end part of the storage case 15 is connected to a rear end part of the horn 12C. A length of each side of a front surface of the storage case 15 is substantially equal to a diameter of the speaker 11. The shape of the storage case 15 is not limited to a rectangular parallelepiped shape, and may be a cylindrical shape.

The slit opening 13C is formed on a front surface of the horn 12C. The slit opening 13C has a rectangular shape whose vertical side is longer than a horizontal side. The slit opening 13C is formed inside of an outer edge of the front surface of the horn 12C.

The horn 12C includes a front panel 124 provided in a sound output direction. The slit opening 13C is formed on the front panel 124. The area of the front surface of the horn 12C is larger than the area within an outer edge of the rear end part of the horn 12C.

Sound output from the speaker 11 travels through an internal space in the horn 12C and is emitted from the slit opening 13C formed on the front surface of the horn 12C.

As described above, the slit opening 13C is formed on the front surface of the horn 12C. Consequently, with a diffraction effect of the slit opening 13C, horizontal directivity of the sound emitted from the slit opening 13C can be made close to a point sound source, and sound reproduction performance in the horizontal direction can be enhanced. In addition, as the sound emitted from the slit opening 13C has forward directivity, with a horn effect of the horn 12C, the sound is prevented from diffusing in the vertical direction and unnecessary sound is prevented from being reflected in the vertical direction.

While the slit opening 13C is formed inside of the outer edge of the front surface of the horn 12C in the fourth embodiment, the present disclosure is not particularly limited thereto, and the outer edge of the slit opening 13C may match the outer edge of the front surface of the horn 12C. In this case, the horn 12C has a tapered shape from an outer edge of the rear end part of the horn 12C toward the slit opening 13C.

The speaker device and the area reproduction apparatus according to the present disclosure can prevent unnecessary sound from being reflected in the vertical direction and can enhance the sound reproduction performance in the horizontal direction. Consequently, the speaker device and the area reproduction apparatus according to the present disclosure are useful as a speaker device that outputs sound and an area reproduction apparatus that outputs sound from a speaker array in which a plurality of the speaker devices are arranged in a predetermined area.

This application is based on Japanese Patent application No. 2019-023515 filed in Japan Patent Office on Feb. 13, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A speaker device, comprising:

a speaker that outputs sound;

a horn that emits the sound output from the speaker;

a connecting part that connects the speaker and the horn and has a space inside; and a slit opening that is formed on a front surface of the horn, a vertical side of the slit opening being longer than a horizontal side of the slit opening, wherein the connecting part includes a front panel provided in a direction of outputting the sound and a sound conduit that penetrates the front panel and is connected to a rear end part of the horn, and a gap is formed between a rear end part of the sound conduit and a front surface of the speaker.

2. The speaker device according to claim 1, wherein the speaker device is used for a speaker array that reproduces the sound in a predetermined area, and a plurality of speaker devices are arranged in the speaker array.

3. The speaker device according to claim 1, wherein the slit opening is formed inside of an outer edge of the front surface of the horn.

4. The speaker device according to claim 1, wherein an outer edge of the slit opening matches an outer edge of the front surface of the horn.

5. The speaker device according to claim 1, wherein the connecting part removes sound in a predetermined frequency band from the sound output from the speaker.

6. The speaker device according to claim 5, wherein the connecting part connects the speaker and the horn with a center of the speaker matching a center of the horn.

7. The speaker device according to claim 5, wherein the connecting part connects the speaker and the horn with a center of the speaker shifting from a center of the horn.

8. The speaker device according to claim 1, wherein the horn includes a folding part that reflects the sound in a direction opposite to a direction of outputting the sound and a reflecting part that reflects the sound reflected by the folding part again in the direction of outputting the sound.

9. An area reproduction apparatus, comprising:

a speaker array in which a plurality of speaker devices are arranged; and an output controller that adjusts a sound pressure of sound to be output from each of the plurality of speaker devices and reproduces the sound in a predetermined area, based on a control line including a reproduction line in which sound waves emitted from the speaker array are intensified and a non-reproduction line in which the sound waves are weakened, wherein each of the plurality of speaker devices is the speaker device according to claim 1.

* * * * *